US010323834B2

(12) United States Patent
Corbo

(10) Patent No.: US 10,323,834 B2
(45) Date of Patent: Jun. 18, 2019

(54) ROTABLE LIGHT ASSEMBLY FOR AN ELECTRONICS RACK

(71) Applicant: Middle Atlantic Products, Inc., Fairfield, NJ (US)

(72) Inventor: Nico Corbo, Blairstown, NJ (US)

(73) Assignee: Middle Atlantic Products, Inc., Fairfield, NJ (US)

( * ) Notice: Subject to any disclaimer, the term of this patent is extended or adjusted under 35 U.S.C. 154(b) by 235 days.

(21) Appl. No.: 15/615,436

(22) Filed: Jun. 6, 2017

(65) Prior Publication Data

US 2018/0347796 A1 Dec. 6, 2018

(51) Int. Cl.

| | |
|---|---|
| ***F21S 8/00*** | (2006.01) |
| ***F21V 21/06*** | (2006.01) |
| ***F21V 21/26*** | (2006.01) |
| ***F21V 21/30*** | (2006.01) |

(52) U.S. Cl.

CPC ..... *F21V 21/30* (2013.01); *F21V 21/06* (2013.01); *F21V 21/26* (2013.01); *F21S 8/036* (2013.01)

(58) Field of Classification Search

CPC ..... F21V 21/26; F21V 21/28; F21V 21/29; F21V 21/30; F21V 17/107; F21V 17/18; F21S 8/036

See application file for complete search history.

(56) References Cited

U.S. PATENT DOCUMENTS

| | | | | |
|---|---|---|---|---|
| 3,108,751 | A * | 10/1963 | Rodmaker | F21S 8/00 362/427 |
| 5,515,744 | A * | 5/1996 | Liao | B62K 21/16 403/373 |
| 6,142,644 | A * | 11/2000 | Leung | F21V 21/0885 362/157 |
| 9,046,231 | B2 * | 6/2015 | Christ | F21L 4/08 |
| 2008/0198588 | A1 * | 8/2008 | O'Hern | F21L 4/00 362/183 |
| 2010/0232147 | A1 * | 9/2010 | Bryant | F21L 4/08 362/183 |
| 2014/0085909 | A1 * | 3/2014 | Ahn | F16M 11/10 362/382 |
| 2015/0159818 | A1 * | 6/2015 | Dong | H05B 33/0854 315/151 |
| 2015/0377464 | A1 * | 12/2015 | Ju | G02B 6/0073 362/612 |
| 2017/0016611 | A1 * | 1/2017 | Hodgson | F21V 31/005 |

* cited by examiner

*Primary Examiner* — Alexander K Garlen
(74) *Attorney, Agent, or Firm* — Drinker Biddle & Reath LLP

(57) ABSTRACT

A light assembly with a light fixture and a rotatable mounting assembly. The mounting assembly includes a base that has a mounting flange with a cradle attached thereto that has an inner race with a curved surface and a plurality of teeth projecting radially inward. A stanchion is mounted adjacent to the cradle and has an axle extending laterally outward therefrom over the cradle. The axle has a center axis that is coaxial with a radial axis of the inner race. A light mount rotatably mounted to the base. The light mount includes a fixture bracket that is attached to the light fixture. The light mount includes a mount frame with an outer race that has a curved surface, and a hub mounted to the axle with an axis that is coaxial with a radial axis of the outer race and the axle axis.

14 Claims, 5 Drawing Sheets

ROTABLE LIGHT ASSEMBLY FOR AN ELECTRONICS RACK

FIELD OF THE INVENTION

The present invention relates to a light assembly and, more particularly, to a rotatable light assembly for mounting to an electronics rack.

BACKGROUND

Electronics equipment, such as audio visual components and computer servers, are in many cases housed on racks designed to store and protect the equipment. Typically such racks are dimly lit, if lit at all, making maintenance of the equipment difficult. Maintenance personnel generally have to rely upon overhead lighting or portable flashlights to provide illumination.

Generally existing lighting is fixed in the direction of illumination, which could result in poor illumination, or even shadows being cast on the equipment making maintenance and inspection difficult.

A need, therefore, exists for an improved light assembly that permits orientation of a light fixture.

SUMMARY OF THE INVENTION

A light assembly for an electronics rack that includes a light fixture with a housing within which is mounted a light source, a cover mounted over the light source, and a rotatable mounting assembly for attaching the light fixture to an electronics rack. The mounting assembly includes at least one base that has a mounting flange adapted to be secured to the electronics rack. A support cradle is attached to the mounting flange and has an inner race with a curved surface defined by a radial axis. The inner race has a plurality of teeth formed on at least a portion of the curved surface. The teeth project radially inward. A stanchion is mounted to the flange adjacent to the cradle and has an axle extending laterally outward therefrom over the cradle. The axle has a center axis that is coaxial with the radial axis of the inner race.

At least one light mount is attached to the base. The light mount includes a fixture bracket that is removably attached to a portion of the light fixture. The light mount includes a mount frame with an outer race that has a curved surface, and a center hub with a hub axis that is coaxial with the radial axis of the outer race. The hub is rotatably mounted to the axle with the hub axis coaxial with the axle axis such that rotation of the mount frame causes the outer race to rotate relative to the inner race.

Preferably the light housing is an elongated housing and the light source is a strip of light emitting diodes.

In an embodiment the flange includes a plurality of notches that are sized to received screws for attaching to holes in the electronics rack for securing the base to the rack.

In an embodiment, the cradle includes at least one retention tab, and wherein the curved surface of the outer race has at least one notch formed in the surface of the outer race and adapted to permit passage of the retention tab, the mount frame being locked onto the axle by the retention tab. Optionally, the mount frame, and thus the light mount, is removable from the axle when the notch is aligned with the retention tab. In an embodiment, there are two retention tabs attached to the cradle at spaced apart locations on the opposite side of the cradle from the stanchion, and wherein there are two notches formed in the surface of outer race, the two notches are located so as to align with the two retention tabs.

Preferably the outer race includes a ratchet tooth that projects radially outward from the curved surface of the outer race so as to contact the teeth on the inner race and thereby provide ratcheting engagement.

In an embodiment, the hub axis is parallel to a longitudinal axis of the channel of the light mount.

The fixture bracket may include an open channel with two retaining lips, the channel configured to slidingly receive an end of housing of the light fixture.

In an embodiment, the mounting assembly includes two bases and two light mounts, where one base and light mount combination is attached to each end of the light fixture, and wherein the hub axes of the light mounts are coaxial with one another.

The foregoing and other features of the invention and advantages of the present invention will become more apparent in light of the following detailed description of the preferred embodiments, as illustrated in the accompanying figures. As will be realized, the invention is capable of modifications in various respects, all without departing from the invention. Accordingly, the drawings and the description are to be regarded as illustrative in nature, and not as restrictive.

BRIEF DESCRIPTION OF THE DRAWINGS

For the purpose of illustrating the invention, the drawings show a form of the invention which is presently preferred. However, it should be understood that this invention is not limited to the precise arrangements and instrumentalities shown in the drawings.

DETAILED DESCRIPTION OF THE PREFERRED EMBODIMENTS

Figure 1:
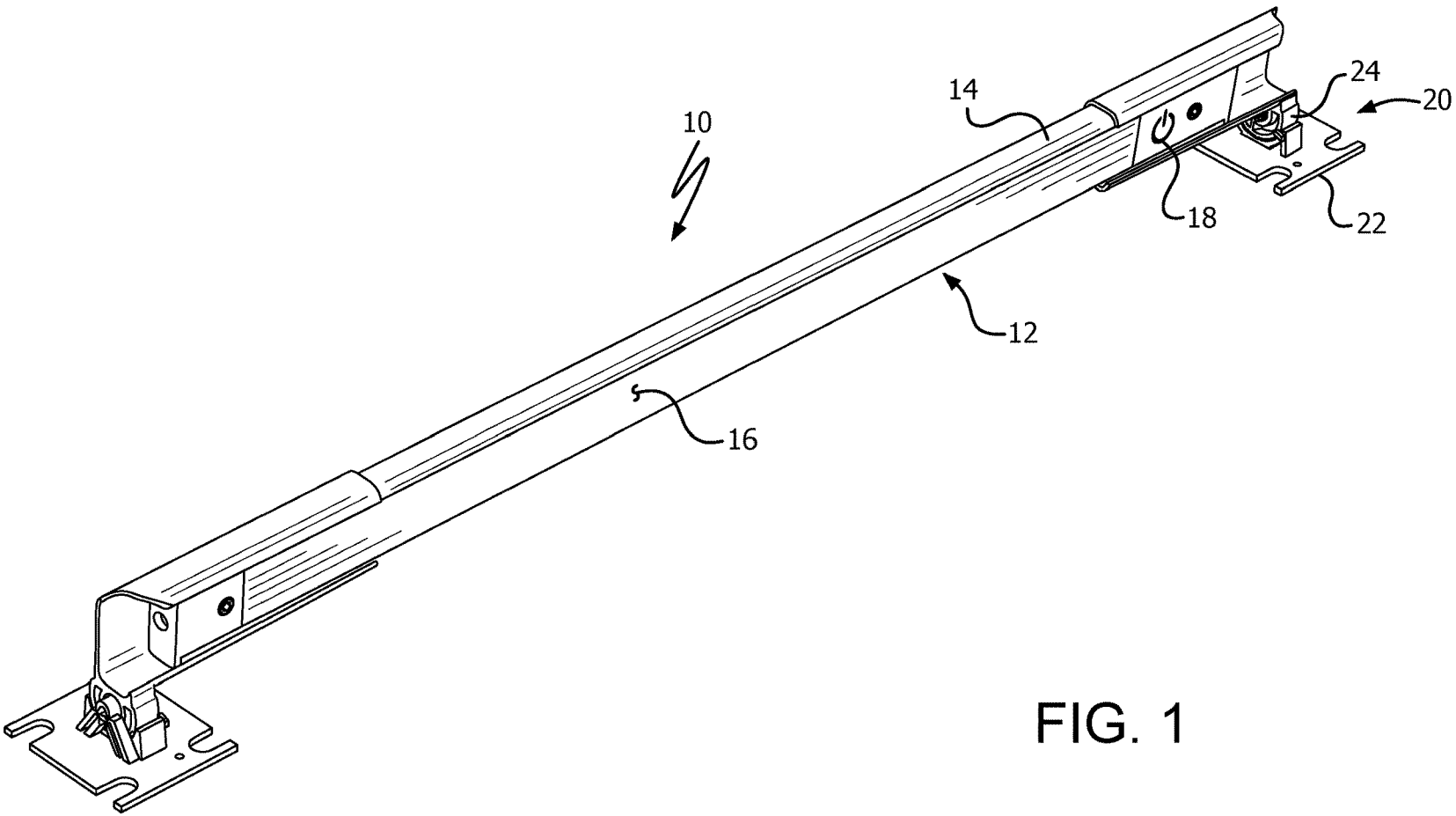
FIG. 1 is a perspective view of a rotatable rack mountable light assembly according to an embodiment of the invention with the light fixture rotated in one orientation.

Referring to the figures, a light assembly 10 is shown for mounting to an electronics rack. The light assembly 10 includes a light fixture 12, with a housing 14 within which are mounted a light source (not shown), such as a strip of light emitting diodes (LEDs). A translucent or transparent cover 16 is mounted over the light source. A power source (not shown), such as a conventional A/C supply or an internally mounted battery supply, provides power to the light source. A switch 18 controls operation of the light source. The details of the light fixture 12 and its operation are conventional and, thus, no further discussion is necessary.

The light fixture is removably attached to a rotatable mounting assembly 20. The mounting assembly 20 includes at least one base 22, and at least one light mount 24 that attaches to the light fixture 12. The base 22 includes a mounting flange 26 that is adapted to be secured to an electronics rack. In the illustrated embodiment, the flange 26 includes a plurality of notches 28 that are sized to received screws for attaching to holes in the electronics rack to secure the base 22 to the rack. The base 22 also includes a support cradle 30 that is fixed or otherwise attached to the flange 26 and includes an inner race 32 with a curved surface that is preferably semi-circular in shape with a radial axis IA. The inner race 32 preferably has a plurality of teeth 34 formed on at least a portion of the surface of the inner race.

An axle 36 is mounted to and extends laterally outward from a stanchion 38 that is mounted adjacent to the cradle 30. The axle 36 has a center axis A that is coaxial with the radial axis IA of the inner race 32. The axle 36 preferably includes one or more resilient legs 40 that are cantilevered off of the stanchion 38. In the illustrated embodiment, there are four legs 40. The cradle 30 also optionally has at least one retention tab 42. More preferably, there are two retention tabs 42 attached to the cradle at spaced apart locations on the opposite side of the cradle 30 from the stanchion 48.

The light mount 24 includes a fixture bracket 44 that removably attaches to a portion of the light fixture 12. In the illustrated embodiment, the fixture bracket 44 includes an open channel 46 with two retaining lips 48. The channel 46 is configured to slidingly receive an end of housing 14 so that the retaining lips 48 prevent removal. A screw or bolt 50 could be used to secure the housing 14 to the fixture bracket 44.

The light mount 24 also includes a mount frame 52 with an outer race 54 that has a curved surface, preferably at least semi-circular in shape and more preferably slightly greater than semi-circular with a radial axis OA. The outer race 54 optionally has at least one, and more preferably two notches 56 formed in the surface of outer race. The notches 56 are located and sized to receive the retention tabs 42 of the cradle 30. The outer race 54 optionally includes a ratchet tooth 58 that projects radially outward from the outer race 54. The mount frame 52 includes a center hub 60 that has a hub axis HA that is coaxial with the radial axis OA of the outer race 54. The hub axis HA is also preferably parallel to the longitudinal axis of the channel 46 of the light mount 24 such that rotation of the hub axis HA causes the channel, and thus the light fixture, to rotate about the hub axis HA.

Figure 6:
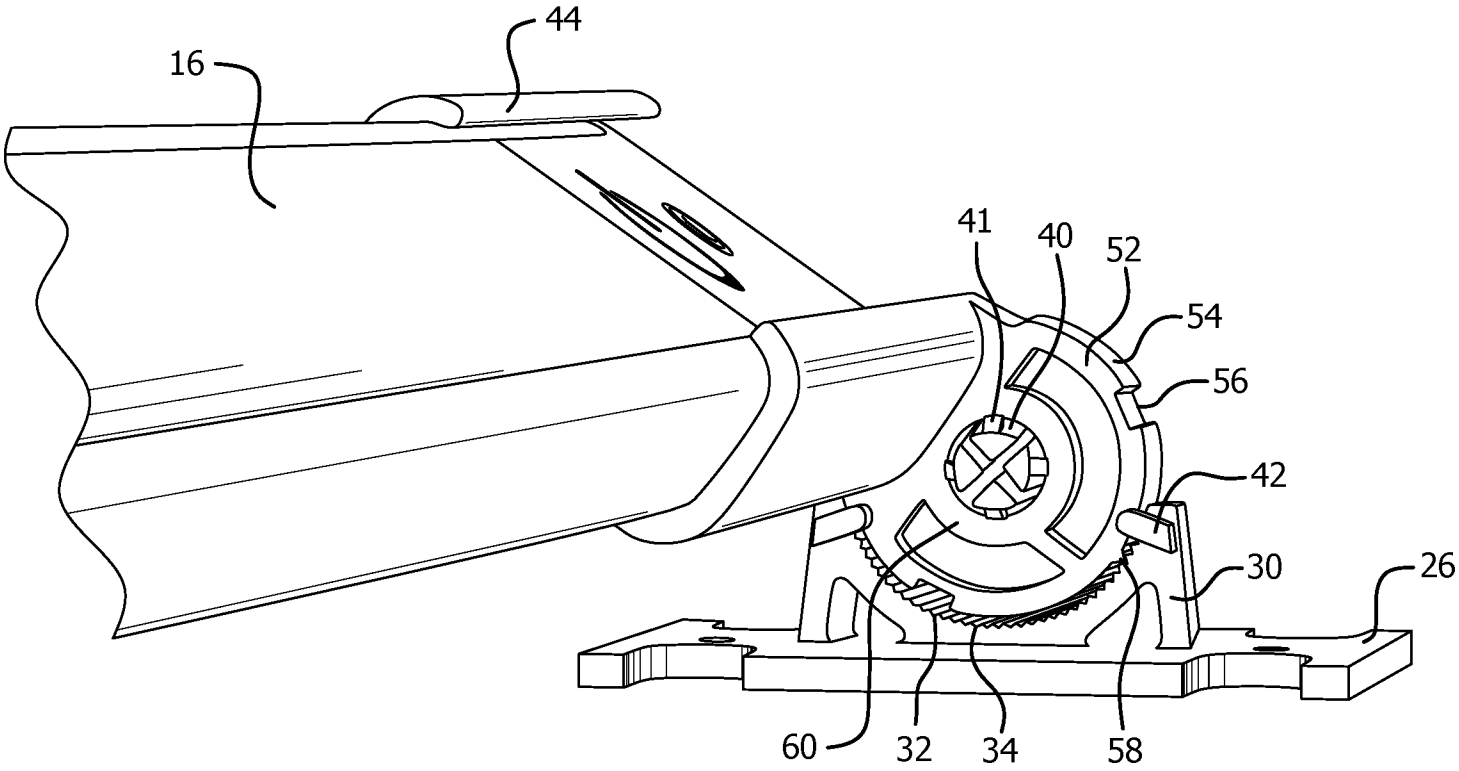
FIG. 6 is an enlarged perspective view of one end of the light assembly of FIG. 1 with the mounting assembly shown assembled.

The light mount 24 is rotatably mounted to the base 22 as shown in FIG. 6. More specifically, the hub 60 is mounted to the axle 36 with the legs 40 of the axle 36 extending through the hub 60, thus locating the hub axis HA coaxial with the axle axis A. As such, rotation of the mount frame 52 causes the outer race 54 to rotate relative to the inner race 32. The ratchet tooth 58 is sized so as to extend outward a sufficient distance from the outer race 54 so that it contacts the teeth 34 on the inner race 32, thereby providing a ratcheting engagement. The ratcheting engagement permits the fixture bracket 44 (and, thus, the light fixture 12) to be resiliently held at different angular positions as it rotates about the hub axis HA. It should be readily apparent to those skilled in the art that other forms of engagement between the outer race and the inner race can be used, such as a frictional engagement. Also, the axle 36 and hub 60 could be reversed such that the hub is mounted to the stanchion and the axle is mounted to the light mount.

Figure 5:
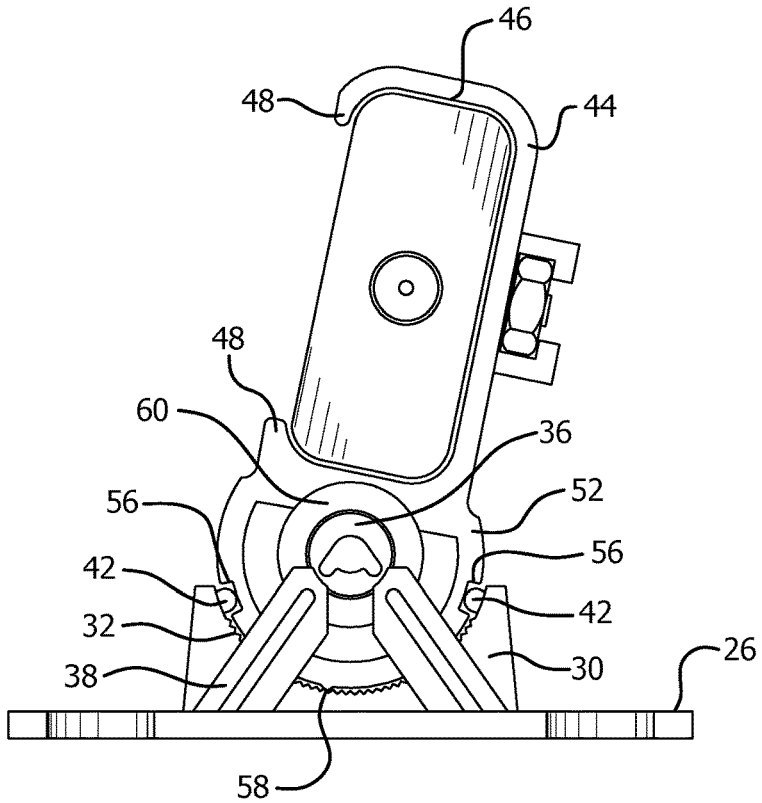
FIG. 5 is an end view of the light assembly of FIG. 1.

As noted above, the legs 40 of the axle are flexible and cantilevered off the stanchion 38. Thus as the hub 60 is slid onto the axle 36, the legs 40 flex. Barbs 41 may be formed on the distal ends of the legs 40 to lock the hub 60 onto the axle 36. The mount frame 52 is locked onto the axle 36 by the retention tabs 42 as shown in FIG. 6. In order to mount the mount frame 52 on the axle 36, the mount frame is positioned so that the notches 56 align with the retention tabs 42 as shown in FIG. 5, The mount frame 52 is then slid onto the axle until it passes the retention tabs 42. At that point, rotation of the mount frame 52 will move the notches 56 out of alignment with the tabs 42, thus preventing removal of the mount frame off the axle 36 (see FIG. 6).

Figure 2:
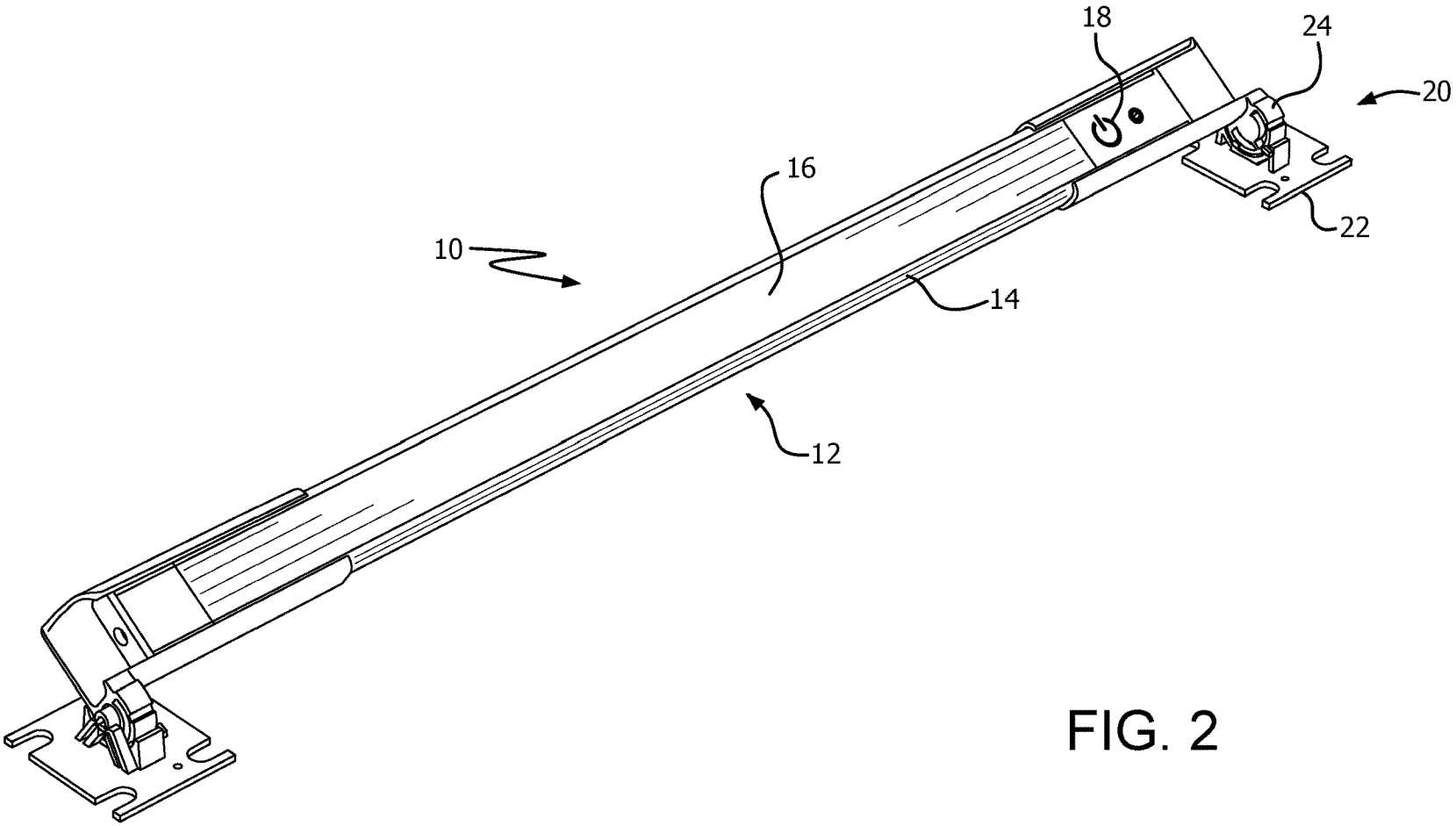
FIG. 2 is a perspective view of the rack mountable light assembly of FIG. 1 with the light fixture rotated into another orientation.
Figure 3:
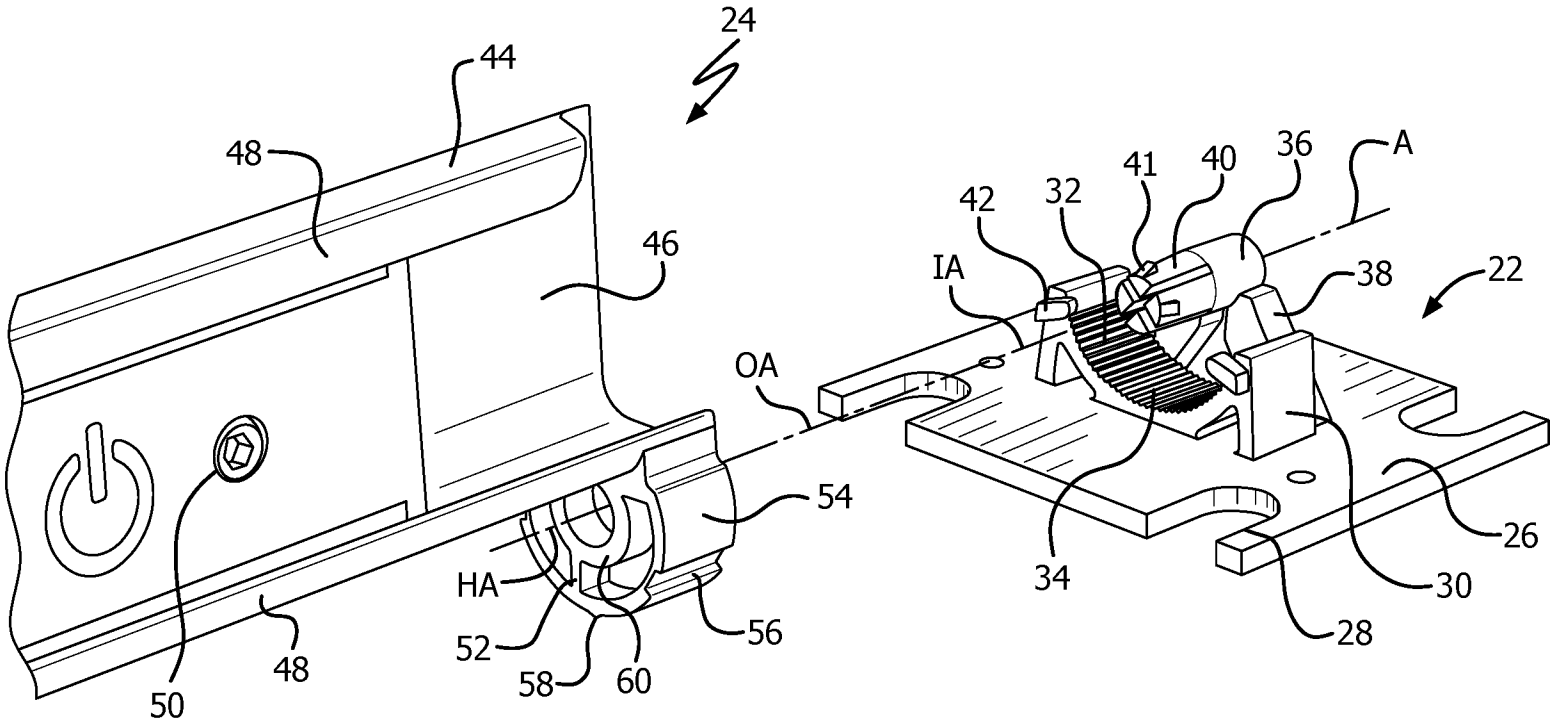
FIG. 3 is an enlarged perspective view of one end of the light assembly of FIG. 1 with the mounting assembly shown separated.
Figure 4:
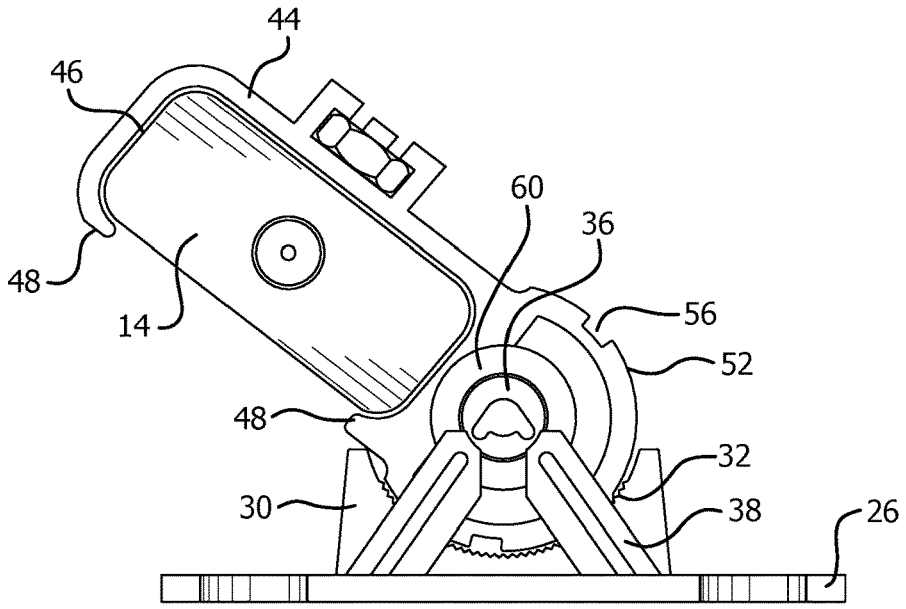
FIG. 4 is an end view of the light assembly of FIG. 2.

In the illustrated embodiment, the mounting assembly 20 includes a base 22 and a light mount 24 at either end of the light fixture 12 with the hub axes HA of the light mounts being coaxial. When the bases 22 are secured to an electronics rack, the configuration of the bases and light mounts permits angular rotation of the light fixture so as to orient the light in the desired direction. See, for example, FIGS. 1 and 2 which show two alternate angular positions of the light fixture. The channels in the light mounts allow for the spacing of the bases to be adjusted. Also, the configuration of the mounting assembly is such that it can be mounted horizontally or vertically.

For the purposes of promoting an understanding of the principles of the invention, reference has been made to embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The invention claimed is:

1. A light assembly for an electronics rack, the light assembly comprising:

a light fixture with a housing within which is mounted a light source, a cover is mounted over the light source; and a rotatable mounting assembly, the mounting assembly including:

at least one base, the base including a mounting flange that is adapted to be secured to an electronics rack, a support cradle attached to the mounting flange, the cradle having an inner race that has a curved surface with a radial axis, the inner race having a plurality of teeth formed on at least a portion of the curved surface of the race and projecting radially inward, and a stanchion mounted to the flange adjacent to the cradle, the stanchion having an axle extending laterally outward therefrom over the cradle, the axle having a center axis that is coaxial with the radial axis of the inner race; and at least one light mount, the light mount including a fixture bracket that removably attaches to a portion of the light fixture, and a mount frame with an outer race that has a curved surface with a radial axis, the mount frame having a hub with a hub axis that is coaxial with the radial axis of the outer race, the hub being rotatably mounted to the axle with the hub axis coaxial with the axle axis such that rotation of the mount frame causes the outer race to rotate relative to the inner race.

2. A light assembly according to claim 1, wherein the light housing is an elongated housing and wherein the light source is a strip of light emitting diodes.

3. A light assembly according to claim 1, wherein the flange includes a plurality of notches that are sized to received screws for attaching to holes in the electronics rack for securing the base to the rack.

4. A light assembly according to claim 1, wherein the curved surface of inner race is substantially semi-circular in shape.

5. A light assembly according to claim 1, wherein the axle includes a plurality of resilient legs that are cantilevered off of the stanchion and adapted to resiliently receive the hub.

6. A light assembly according to claim 1, wherein the cradle includes at least one retention tab, and wherein the curved surface of the outer race has at least one notch formed in the surface of the outer race and adapted to permit passage of the retention tab, the mount frame being locked onto the axle by the retention tab.

7. A light assembly according to claim 6, wherein the mount frame is removable from the axle when the notch is aligned with the retention tab.

8. A light assembly according to claim 6, wherein there are two retention tabs attached to the cradle at spaced apart locations on the opposite side of the cradle from the stanchion, and wherein there are two notches formed in the surface of outer race, the two notches being located so as to align with the two retention tabs.

9. A light assembly according to claim 1, wherein the outer race includes a ratchet tooth that projects radially outward from the curved surface of the outer race so as to contact the teeth on the inner race and thereby provide ratcheting engagement.

10. A light assembly according to claim 9, wherein the fixture bracket includes an open channel with two retaining lips, the channel configured to slidingly receive an end of housing of the light fixture, the channel having a longitudinal axis.

11. A light assembly according to claim 10, wherein the hub axis is parallel to the longitudinal axis of the channel of the light mount.

12. A light assembly according to claim 11, wherein the curved surface of the outer race is at least substantially semi-circular in shape.

13. A light assembly according to claim 1 wherein the mounting assembly includes two bases and two light mounts, where one base and one light mount are attached to opposite ends of light fixture, and wherein the hub axes of the light mounts are coaxial with one another.

14. A light assembly according to claim 13, wherein the fixture bracket of each light mount includes an open channel with two retaining lips, the channel configured to slidingly receive an end of housing of the light fixture, the channel having a longitudinal axis, and wherein the channels of the light mounts permit adjustment of the spacing between the bases.

* * * * *